US010513027B2

(12) United States Patent
Moreau et al.

(10) Patent No.: US 10,513,027 B2
(45) Date of Patent: Dec. 24, 2019

(54) TOOL BAG CARRYING HANDLE WITH AUXILIARY LOOP

(71) Applicant: TY-FLOT, INC., Manchester, NH (US)

(72) Inventors: Darrell A. Moreau, Manchester, NH (US); Andre W. Moreau, Bedford, NH (US)

(73) Assignee: Pure Safety Group, Inc., Pasadena, TX (US)

( * ) Notice: Subject to any disclaimer, the term of this patent is extended or adjusted under 35 U.S.C. 154(b) by 449 days.

(21) Appl. No.: 15/142,360

(22) Filed: Apr. 29, 2016

(65) Prior Publication Data

US 2017/0313476 A1 Nov. 2, 2017

(51) Int. Cl.
*B25H 3/00* (2006.01)

(52) U.S. Cl.
CPC ..... *B25H 3/00* (2013.01)

(58) Field of Classification Search
CPC ..... A45F 3/14; A45F 2003/142; A45F 2003/146; A45F 2003/148; B25H 3/00
USPC ..... 123/518; 294/137; 220/757
See application file for complete search history.

(56) References Cited

U.S. PATENT DOCUMENTS 6,237,533 B1 * 5/2001 Rodriguez ..... A01K 27/006 119/161
2003/0201655 A1 * 10/2003 Zellmer ..... A45C 11/00 294/150

OTHER PUBLICATIONS

Global Industrial, Lift-All BS5 Bucket Sling, available at http://www.globalindustrial.com/p/material-handling/hoists-cranes/lifting-slings-straps/li-all-174-bs5-5-gallon-bucket-sling-200-lb-capacity (admitted prior art).
Black Rapid, R Strap, available at http://www.blackrapid.com/products/sport (admitted prior art).
Teskey's, Classic Equine Bucket Strap, available at http://www.teskeys.com/ranch-supplies/bam-hardware/buckets-feeders/classic-equine-bucket-strap.html (admitted prior art).
Sling Shot, Weightlifting strap (admitted prior art).

* cited by examiner

*Primary Examiner* — Steven A. Reynolds
*Assistant Examiner* — Javier A Pagan
(74) *Attorney, Agent, or Firm* — Dicke, Billig & Czaja, PLLC

(57) ABSTRACT

A tool bag carrying handle includes a handle portion made of a pliable material and having a handle body extending between a first end portion and a second end portion. An auxiliary loop member has a first auxiliary end portion secured to the handle body and an auxiliary member body portion capable of extending in alignment with and along the handle portion to a second auxiliary end portion that defines a closed loop. The first and second end portions of the handle body are attached or are constructed to be attached to a tool container.

18 Claims, 7 Drawing Sheets

TOOL BAG CARRYING HANDLE WITH AUXILIARY LOOP

BACKGROUND OF THE INVENTION

1. Field of the Invention

The present invention relates generally to containers for storing and transporting hand tools. Particularly, the present invention relates to a carrying strap for a portable tool storage container that is useful for hanging the container above the ground.

2. Description of the Prior Art

Persons engaged in repair, construction, and industrial maintenance use a variety of hand tools to perform their work. The worker may use a tool belt, but often also carries a tool box or tool bag to carry tools that cannot be stored on the tool belt due to space or size limitations.

One form of a tool bag is a tool bucket made of canvas or other pliable material and including a flexible handle with a connector hook. For example, one hanging tool bag has a generally cylindrical container made of heavy canvas. The sidewall of the container tapers slightly from the mouth towards the bottom of the bucket. A rope handle is secured to opposite sides of the bucket along the mouth. Optionally, the user may attach a swivel snap hook to the handle for hanging the tool bucket. The user clips the snap hook to a ladder hook, ceiling hook, or overhead cable to suspend the tool bag off of the ground for convenient access to tools.

SUMMARY OF THE INVENTION

A deficiency of conventional tool bags is that the carrying strap is designed for carrying the tool bucket rather than to be used for hanging the bucket. A hook or connector attached to the carrying strap or handle is typically not large enough to clip onto beams, large pipes, and other structural members. A connector large enough to attach to these structures would be unwieldy and heavy. Thus, the tool bag or tool bucket can only be suspended off the ground when an appropriately sized hook is available.

One approach to this problem has been to supply a separate tie-down strap or bungee cord that loops over a pipe or other structure and then hooks to the handle or connector on the tool bag. A deficiency with this approach is that the user must remember to pack the tie-down strap in the tool bag for it to be useful when needed. The tie-down strap consumes space in the tool bag and sometimes can get moved to the bottom of the bag underneath tools where it is a hassle to retrieve.

Another deficiency when using a separate tie-down strap is that when a worker hoists a loaded tool bag up to the height of the tie-down strap, brings the ends of the tie-down strap together, and then clips a connector to the tie-down strap, these actions may result in tipping the tool bag, bumping the tool bag, or a missed attempt to clip the connector on the strap or handle that causes dropping tools or other equipment. When working at height or in a location with equipment or people located below, a dropped strap with metal connector or a dropped tool can damage equipment and cause serious injury to workers below.

Therefore, what is needed is a tool storage container, such as a tool bag, that has a carrying handle equipped for connection to structures that are too large for a common carabiner or hook, that eliminates the need for a separate tie-down strap, and maintains the utility of the carrying handle for carrying the tool bag. The present invention achieves these and other objectives by providing a tool-container carrying handle with an auxiliary loop.

One aspect of the present invention is directed to a tool bag with a container and a carrying handle with auxiliary loop member. The container has a bottom and a sidewall extending up from the bottom to an open mouth. The carrying handle is made of a pliable material and has a body portion, a first end portion, and a second end portion, where the first end portion is attached to a first side of the container adjacent the open mouth and the second end portion is attached to a second side of the container adjacent the open mouth. The body portion of the carrying handle extends over the open mouth of the container. The auxiliary loop member has an auxiliary member body secured at a first auxiliary end portion to the body portion of the carrying handle. The auxiliary loop member extends along the auxiliary member body separate from and generally aligned with the carrying handle to a second auxiliary end portion that defines a closed loop. A bag-suspending connector is connected to the carrying handle. In one embodiment, the carrying handle and auxiliary loop member are a strap, rope, or other pliable material. In one embodiment, for example, the carrying handle and auxiliary loop member are made of nylon webbing, leather, or rope.

In some embodiments, the tool bag includes a releasable connector with a first connector part on the auxiliary member body portion and a second connector part on the body portion of the carrying handle, thereby rendering the auxiliary loop member releasably attachable to the carrying handle. In one embodiment, the first auxiliary end portion of the auxiliary loop member is secured at about the midpoint of the carrying handle and the auxiliary member body has a length sufficient to extend along the sidewall when the auxiliary loop member is releasably attached to the body portion of the carrying handle. In another embodiment, the sidewall of the container also includes the second connector part, thereby also rendering the auxiliary loop member releasably attachable to the sidewall of the container. In one embodiment, the releasable fastener is a hook-and-loop fastener.

In one embodiment, the handle body portion includes a first handle body portion and a second handle body portion, each of which includes a bag-suspending connector.

In various embodiments, the bag-suspending connector(s) may be slidable along the carrying handle or fixed at a predetermined location along the handle body portion, such at about the midpoint of the handle body.

In another embodiment, the first auxiliary end portion is secured to the carrying strap at about the midpoint of the body portion of the carrying handle that extends over the open mouth. For example, in one embodiment, the first end portion and the second end portion of the carrying strap are permanently secured to the container. In another embodiment, one or both of the first end portion and the second end portion of the carrying strap includes a connector that is releasably connected through an opening in the sidewall adjacent the mouth of the container. Thus, in some embodiment, the carrying handle is removable from the container at one or both end portions.

In some embodiments, the bag-suspending connector is a carabiner or snap hook with a spring-loaded gate operable between an open position and a closed position. For example, the bag-suspending connector is a carabiner with a connector loop, where the carrying handle extends through the connector loop to connect the bag-suspending connector to the carrying handle. In other embodiments, the bag-suspending connector is a D-ring or other closed loop connector.

Another aspect of the present invention is directed to a tool bag carrying handle that includes a handle portion made of a pliable material and having a handle body extending between a first end portion and a second end portion. An auxiliary loop member has a first auxiliary end portion secured to the handle portion and an auxiliary member body portion capable of extending in alignment with and along the handle portion to a second auxiliary end portion that defines a closed loop. A first-end connector is secured to the first end portion of the handle portion and operable between an open position and a closed position. A second-end connector is secured to the second end portion of the handle portion and operable between an open position and a closed position. A bag-suspending connector is connected to the handle portion.

In another embodiment, the carrying handle includes a releasable fastener having a first fastener part and a second fastener part. The first fastener part is attached to the auxiliary loop member and the second fastener part is attached to the handle portion. When the auxiliary member body portion is brought together with the handle portion, the first fastener part is aligned to releasably engage the second fastener part. In one embodiment, the releasable fastener is a hook-and-loop fastener with the first fastener part being a loop portion and the second fastener part being a hook portion or vice versa.

In some embodiments, the bag-suspending connector is slidable along the handle portion. In other embodiments, the bag-suspending connector is fixed at about at a midpoint of the handle portion.

In some embodiments, the first auxiliary end portion defines a connector loop that is slidable along the handle portion. In other embodiments, the first auxiliary end portion has a fixed position along the handle portion, such as being fixed at or near a midpoint of the handle portion.

DETAILED DESCRIPTION OF THE PREFERRED EMBODIMENT

Figure 1:
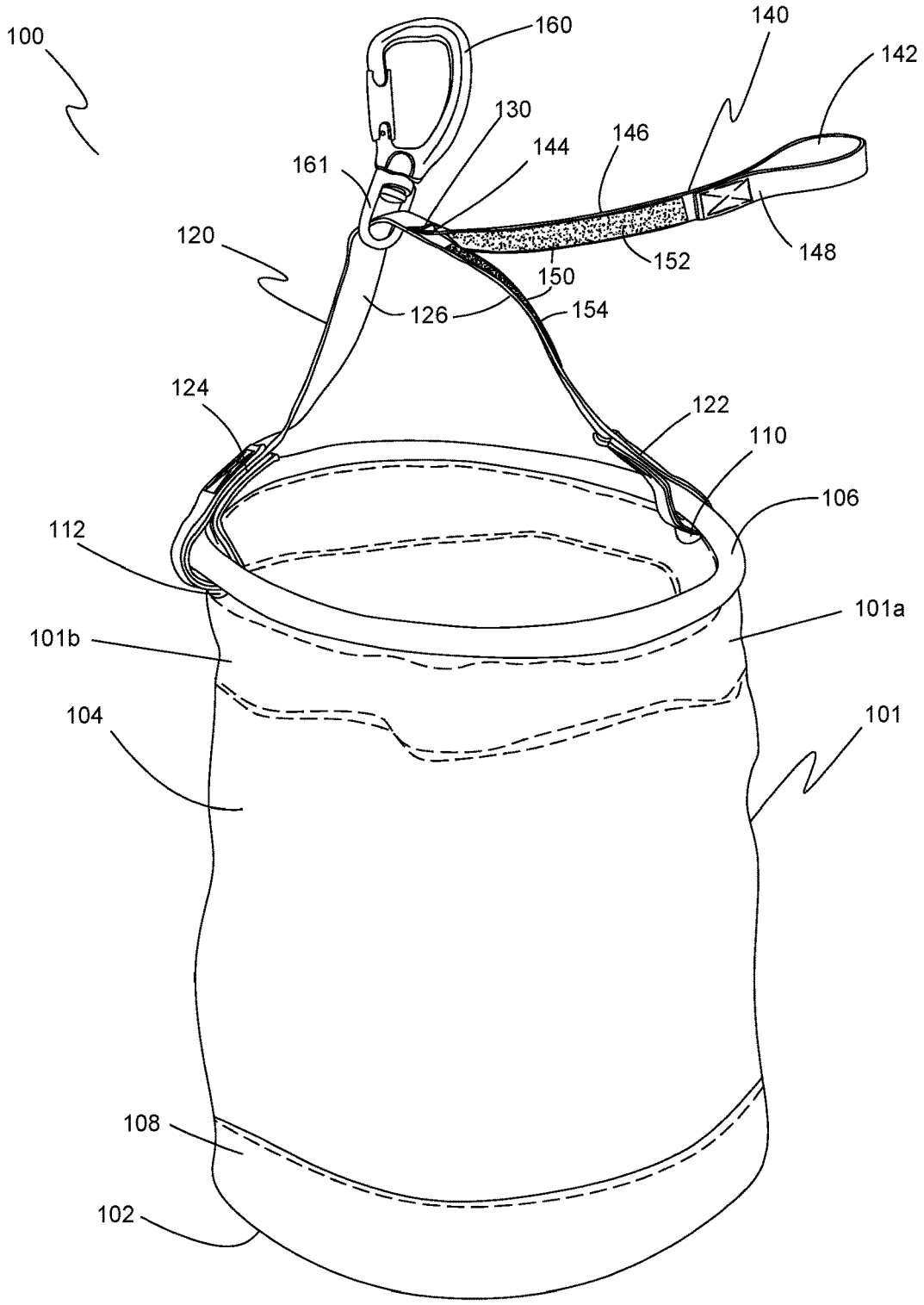
FIG. 1 is a perspective view of one embodiment of a tool bag with a carrying handle of the present invention that includes a bag-suspending connector and an auxiliary loop member with a closed loop.

The preferred embodiment(s) of the present invention is illustrated in FIGS. 1-7. FIG. 1 illustrates a front perspective view of one embodiment of a tool bag 100 that includes a carrying handle 120 with an auxiliary loop member 140 and a bag-suspending connector 160 attached to carrying handle 120. Bag-suspending connector 160 has a connector loop 161, where carrying handle 120 extends through connector loop 161 and allows bag-suspending connector 160 to slide along carrying handle 120. In other embodiments, bag-suspending connector 160 has a fixed position along carrying handle 120.

Tool bag 100 has a container 101 with a bottom 102, a sidewall 104, and an opening or mouth 106, where sidewall 104 extends up from bottom 102 to mouth 106. Container 101 is sized and constructed to hold hand tools and hand-held equipment and supplies. In one embodiment, container 101 is made at least in part of a pliable material such as canvas, leather, ballistic nylon, rubberized textiles and the like. In other embodiments, container 101 is made at least in part of rigid materials such as plastic or metal. For example, sidewall 104 is made of ballistic nylon and a lower end portion 108 and bottom 102 are made of hard plastic or rubber. Container 101 in another example is similar to a 5-gallon contractor's bucket made of plastic. Container 101 may have any shape, but typically has a circular or rectangular shape as viewed looking into mouth 106.

In one embodiment, container 101 defines a first opening 110 and a second opening 112 each located at or near mouth 106 and spaced from each other on opposite sides of mouth 106. First and second openings 110, 112 may be openings defined in sidewall 104 or in a tab or connector (not shown) connected to and extending from container 101. First and second openings 110, 112 are useful for connecting carrying handle 120 to container 101, such as when carrying handle 120 extends through first and second openings 110, 112 and is secured to itself as shown, for example, in FIG. 1 and FIG. 5.

In one embodiment, carrying handle 120 is made of a pliable material and has a handle body portion 126 that extends across mouth 106 with sufficient slack or length to enable the user to use it to carry tool bag 100. For example, carrying handle 120 is made of nylon webbing, leather, plastic, or rope. In one embodiment, carrying handle 120 has a first end portion 122 connected to a first side 101*a* of container 101 and a second end portion 124 connected to a second side 101*b* of container, where first and second end portions 122, 124 are connected adjacent mouth 106 on opposite sides 101*a*, 101*b* of mouth 106 of container 101. For example, first and second end portions 122, 124 loop through first and second openings 110, 112, respectively. In other embodiments, first and second end portions 122, 124 are stitched or otherwise secured to sidewall 104 or to other parts of container 101. In one embodiment, carrying handle 120 extends down along sidewall 104 and across bottom 102 of tool bag 100 with first and second end portions 122, 124 overlapping and secured to each other and to container 101.

Auxiliary loop member 140 has an auxiliary member body portion 146 with a first auxiliary end portion 144 and a second auxiliary end portion 148. Auxiliary strap body portion 146 extends from first auxiliary end portion 144 to second auxiliary end portion 148, where second auxiliary end portion 148 defines closed loop 142. Auxiliary loop member 140 in some embodiments is a separate length of pliable material that is secured at first auxiliary end portion 144 to handle body portion 126 of carrying handle 120. In one embodiment, closed loop 142 is formed by securing second auxiliary end portion 148 to itself or to auxiliary strap body portion 146. In other embodiments, closed loop 142 is a closed loop of a connector, ring, or other structure secured to second auxiliary end portion 148.

In some embodiments, auxiliary loop member 140 is secured to carrying handle 120 at a midpoint 130 of handle body portion 126 located between first side 101*a* and second side 101*b* of container 101. When auxiliary loop member 140 is a separate piece of material from carrying handle 120, for example, auxiliary loop member 140 originates at first auxiliary end portion 144 that is secured at or near midpoint 130 of handle body portion 126 of carrying handle 120. Auxiliary strap body 146 then extends to second auxiliary end portion 148 as a separate structure that can be aligned with carrying handle 120. On the other hand, when auxiliary loop member 140 is formed as an extension of first end portion 122 of carrying handle 120, for example, first end portion 122 is secured to handle body portion 126 at midpoint 130 and then continues as auxiliary loop member 140 separately from carrying handle 120 to second auxiliary end portion 148. In either case, auxiliary loop member 140 may be aligned with and abut carrying handle 120 along at least part of its length. In other embodiments, first auxiliary end portion 144 is movable along carrying handle 120 rather than having a fixed location.

In some embodiments, tool bag 100 includes a releasable fastener 150 with a first fastener part 152 and a second fastener part 154. For example, auxiliary loop member 140 includes a first fastener part 152 and the corresponding section of carrying handle 120 includes a second fastener part 154 of a releasable fastener 150. In one embodiment, releasable fastener 150 is a hook-and-loop fastener where first fastener part 152 is the hook portion secured along handle body portion 126 of carrying handle 120 and second fastener part is the loop portion 154 secured along auxiliary strap body portion 146. Other acceptable variants of releasable fastener 150 include magnets, snaps, buttons, or other fasteners. When auxiliary loop member 140 extends along and is brought together in alignment with handle body portion 126 of carrying handle 120, first and second fastener parts 152, 154 are aligned for fastening to each other.

Figure 2:
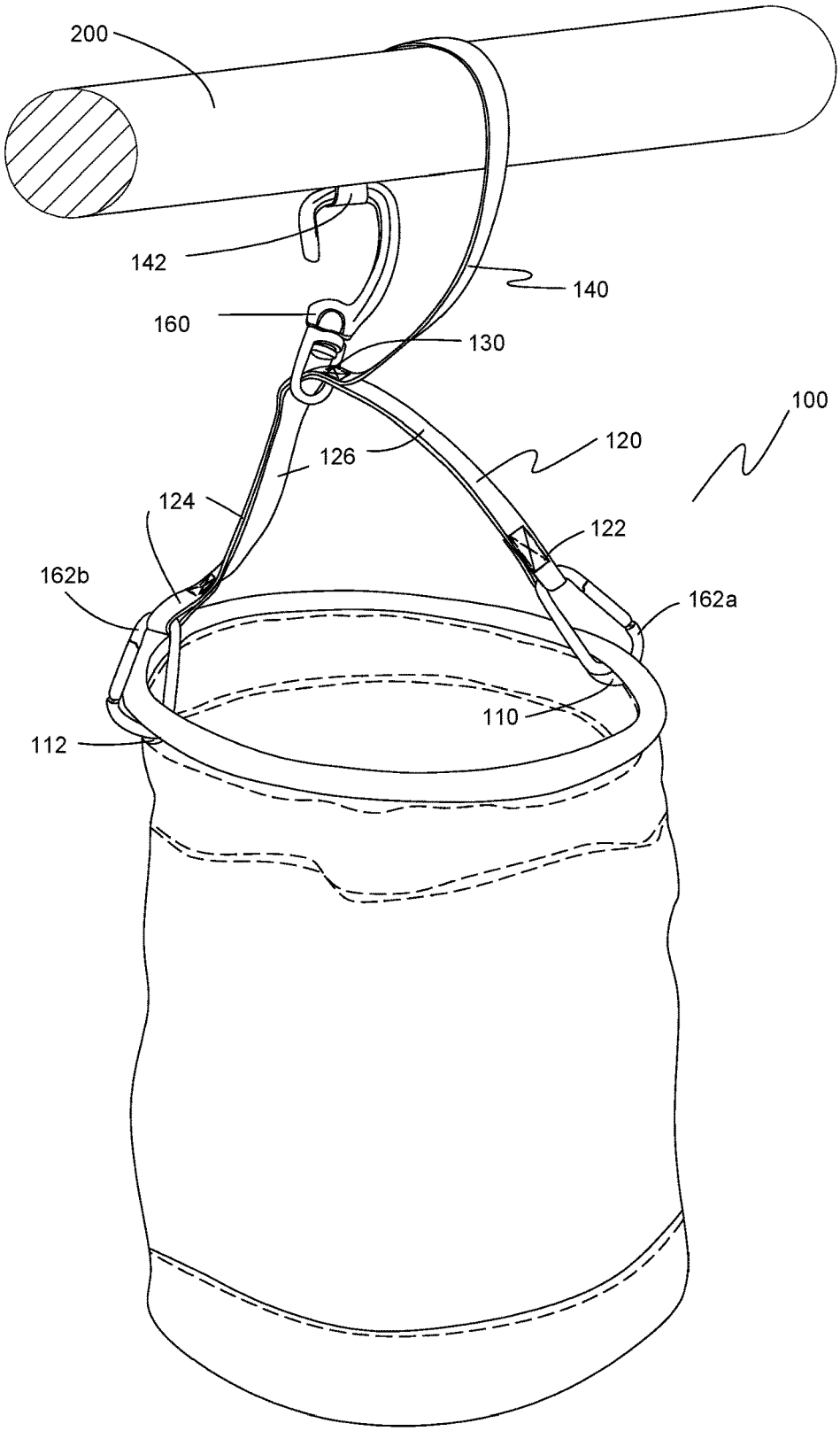
FIG. 2 is a perspective view of another embodiment of a tool bucket with carrying handle of the present invention shown installed over a structure with the closed loop of the auxiliary loop member captured by the bag-suspending connector.

Referring now to FIG. 2, a front perspective view illustrates another embodiment of tool bag 100 with carrying handle 120. First end portion 122 has a first-end connector 162*a* and second end portion 124 has second-end connector 162*b*. In some embodiments, one or both of first-end connector 162*a* and second-end connector 162*b* defines a closed loop and is operable between an open position and a closed position. First-end and second-end connectors 162*a*, 162*b* are constructed for releasable attachment to tool container 101. Therefore, carrying handle 120 is removable from container 101.

In some embodiments as also shown in FIG. 2, for example, part of carrying handle 120 defines auxiliary loop member 140. For example, carrying handle 120 is made of webbing where second end portion 124 is connected through second-end connector 162*b* and then extends along strap handle body portion 126 of carrying handle 120 to become auxiliary loop member 140. Second end portion 124 extends back along handle body portion 126 with second end portion 124 secured at or near midpoint 130 of handle body portion 126. From midpoint 130, second end portion 124 extends unattached from carrying handle 120 as auxiliary loop member 140 and continues separately from carrying handle 120.

FIG. 2 further shows tool bag 100 in use with auxiliary loop member 140 looped over a structure 200 (e.g., a pipe) with closed loop 142 captured by bag-suspending connector 160. As shown, for example, bag-suspending connector 160 is hook that engages closed loop 142 to close auxiliary loop member 140 in a loop around structure 200. In other embodiments, bag-suspending connector 160 is a carabiner that clips to closed loop 142. As shown in FIG. 2, carrying handle 120 and auxiliary lop member 140 are a strap made of nylon webbing, leather, or the like.

Figure 3:
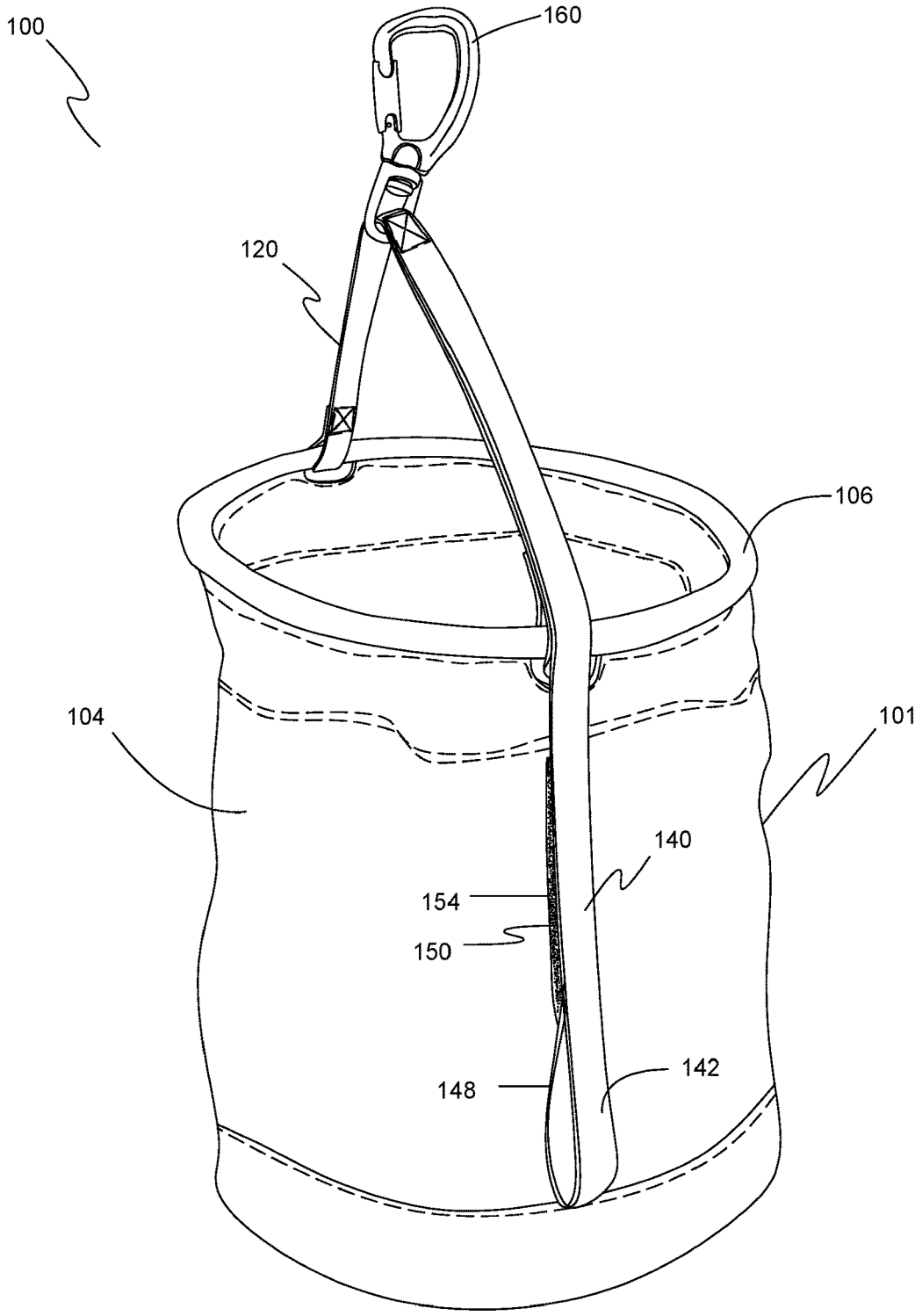
FIG. 3 is a perspective view of another embodiment of a tool bucket with carrying handle of the present invention showing the auxiliary loop member extending down along the sidewall of the container.

Referring now to FIG. 3, a perspective view illustrates yet another embodiment of tool bag 100 with carrying handle 120 and auxiliary loop member 140. In some embodiments, second auxiliary end portion 148 extends beyond mouth 106 of container 101 when auxiliary strap body 146 can be releasably attached along carrying handle 120. To retain auxiliary loop member 140 in a stowed position, carrying handle 120 and container 101 optionally both include second fastener part 154 (e.g., hooks of hook-and-loop fastener) and auxiliary strap body 146 includes first fastener part 152 (e.g., loops of hook-and-loop fastener.) In the stowed position, auxiliary strap body 146 extends along carrying handle 120 and down along sidewall 104 of container 101 with auxiliary loop member 140 retained by releasable fastener 150. By extending from midpoint 130 to a location along sidewall 104 of container 101, auxiliary loop member 140 has a length better suited to wrap around conduits, beams, and larger structures 200 with sufficient length for closed loop 142 to be captured by bag-suspending connector 160. In other embodiments, such as shown in FIG. 1, auxiliary loop member 140 has a length where second auxiliary end portion 148 terminates at or near mouth 106 of container 101.

Figure 4A:
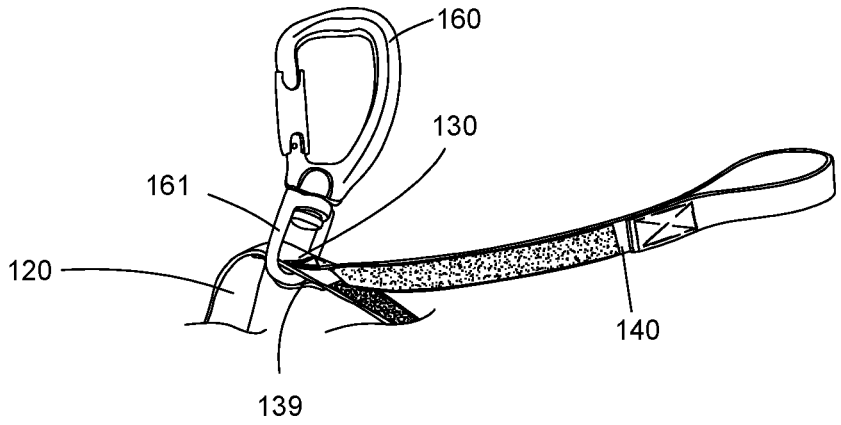
FIG. 4A is a perspective view illustrating an example of a bag-suspending connector having a fixed position along one embodiment of a carrying handle.
Figure 4B:
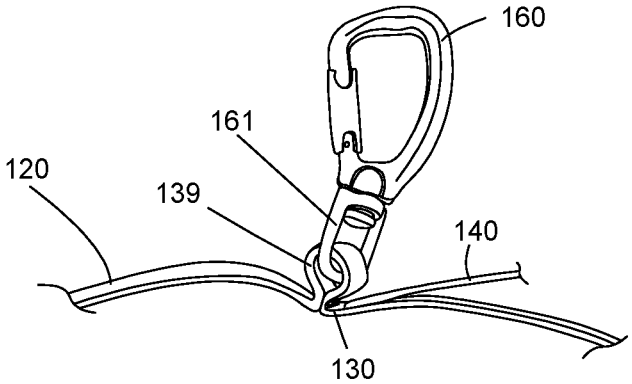
FIG. 4B is a perspective view illustrating another example of a bag-suspending connector having a fixed position along another embodiment of the carrying handle, where the carrying handle is secured to itself to form a loop through the connector.

Referring now to FIGS. 4A and 4B, perspective-views of part of carrying handle 120 illustrate examples of bag-suspending connector 160 having a fixed position along carrying handle 120. In FIG. 4A, bag-suspending connector 160 is fixed at or near midpoint 130 by a securing loop 139 on carrying handle 120. Auxiliary loop member 140 also extends from about midpoint 130. Securing loop 139 is formed with a length of webbing, a metal strap loop, or other object fixed to carrying handle 120. As shown in FIG. 4B, securing loop 139 is formed by folding carrying handle 120 on itself and securing in a loop through connecting loop 161 of bag-suspending connector 160.

Figure 5:
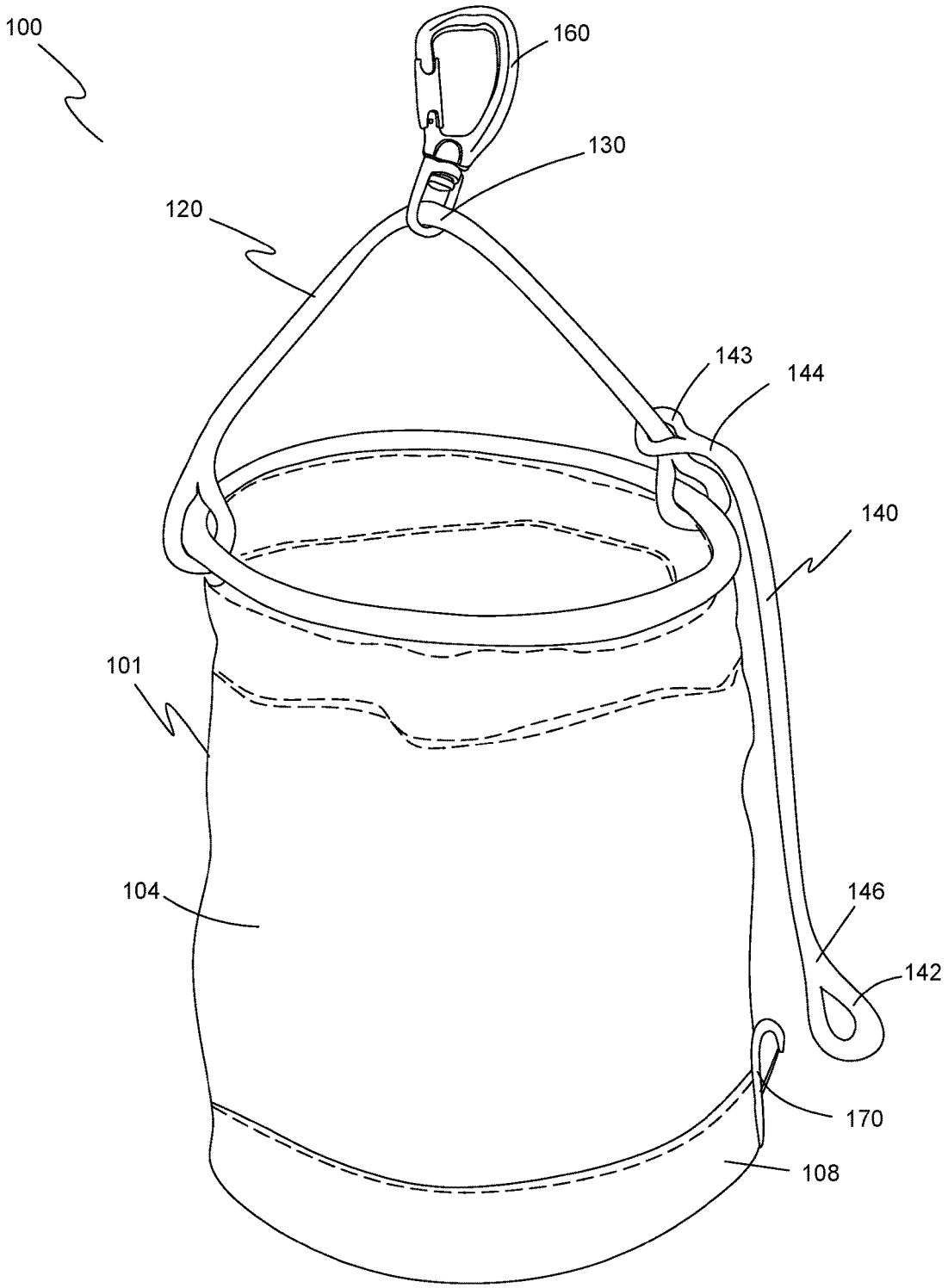
FIG. 5 is a perspective illustration of another embodiment of a tool bag of the present invention showing an auxiliary loop member that is movably connected to the carrying handle and a snap hook attached to the container sidewall.

Referring now to FIG. 5, another embodiment of tool bag 100 has carrying handle 120 and auxiliary loop member 140 made of rope or similarly-shaped material. In addition to closed loop 142 at second auxiliary end portion 146, auxiliary loop member 140 defines a connector loop 143 at first auxiliary end portion 144. Connector loop 143 and closed loop 142 may be formed by securing first auxiliary end portion 144 and second auxiliary end portion 146 to auxiliary member body portion 126, respectively. When auxiliary loop member 140 is made of webbing, for example, first auxiliary end portion 144 and second auxiliary end portion 146 may be secured by stitching, rivets, or other fastener. When auxiliary loop member 140 is made of rope as shown in FIG. 5, for example, first auxiliary end portion 144 and second auxiliary end portion 146 may be woven or braided into auxiliary member body portion 126 and optionally reinforced with an overwrap (not shown). First auxiliary end portion 144 and second auxiliary end portion 146 can be secured to auxiliary member body portion 126 with other methods.

As shown in FIG. 5, connector loop 143 is able to slide along carrying handle 120. When not in use, auxiliary loop member 140 is moved to extend along sidewall 104 and optionally may be retained to container 101 by a snap hook or other sidewall connector 170 secured to lower end portion 108 of container 101. When needed, auxiliary loop member 140 may be positioned with connector loop 143 at or near midpoint 130 so auxiliary loop member 140 may be looped over structure 200 (shown in FIG. 2) with closed loop 142 engaged by bag-suspending connector 160.

Figure 6:
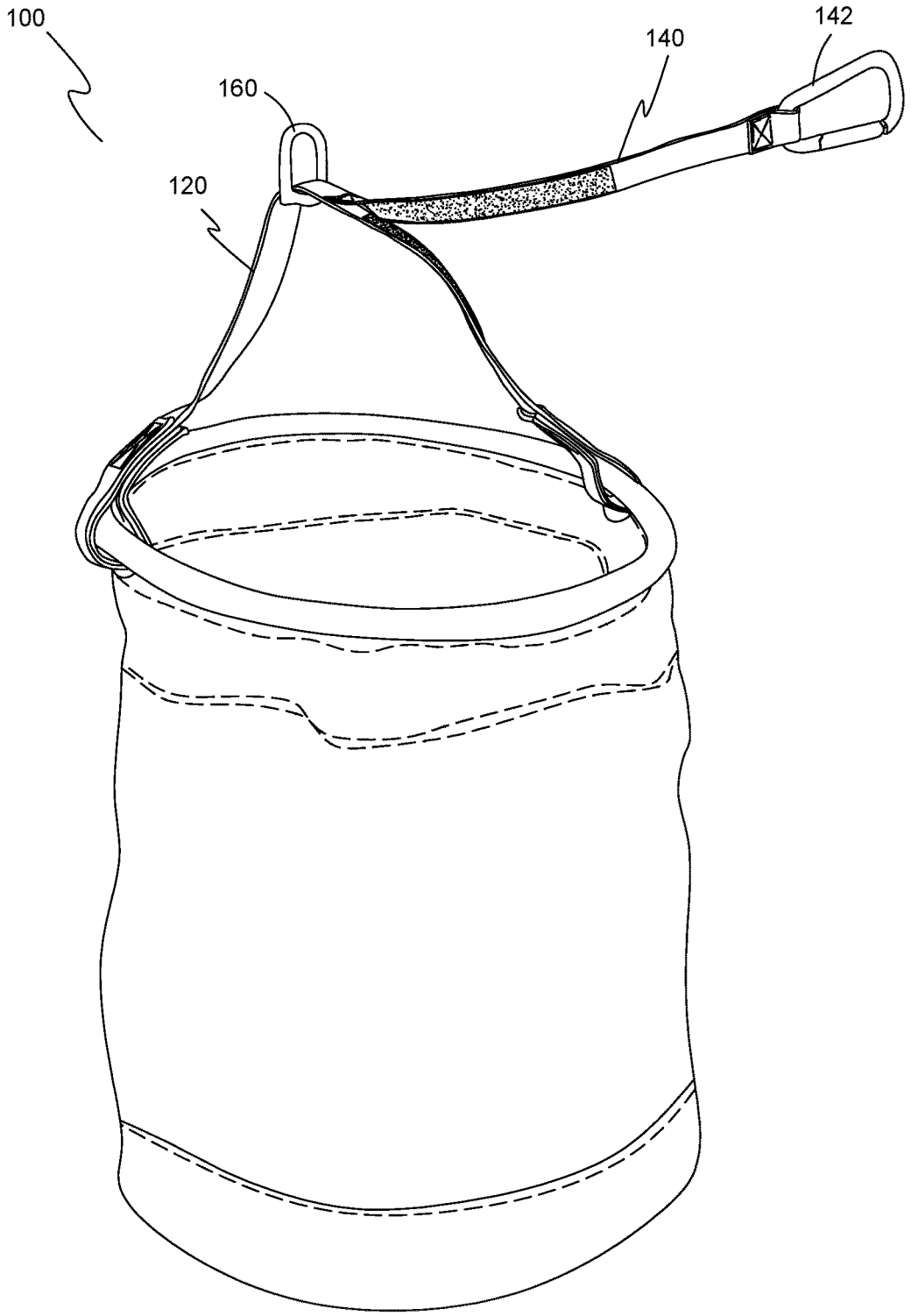
FIG. 6 is a perspective illustration of an embodiment of a tool bag of the present invention showing the bag-suspending connector as a D-ring and the closed loop on auxiliary loop member as a carabiner connector.

FIG. 6 illustrates a perspective view of tool bag 100 with another embodiment of carrying handle 120. In this embodiment, bag-suspending connector 160 is a D-ring or other closed-loop connector. Closed loop 142 on auxiliary loop member 140 is a carabiner or other connector operable between an open position and a closed position. Thus, for example, when auxiliary loop member 140 is wrapped over structure 200 (shown in FIG. 2), closed loop 142, a carabiner, attaches to bag-suspending connector 160, a D-ring.

Figure 7:
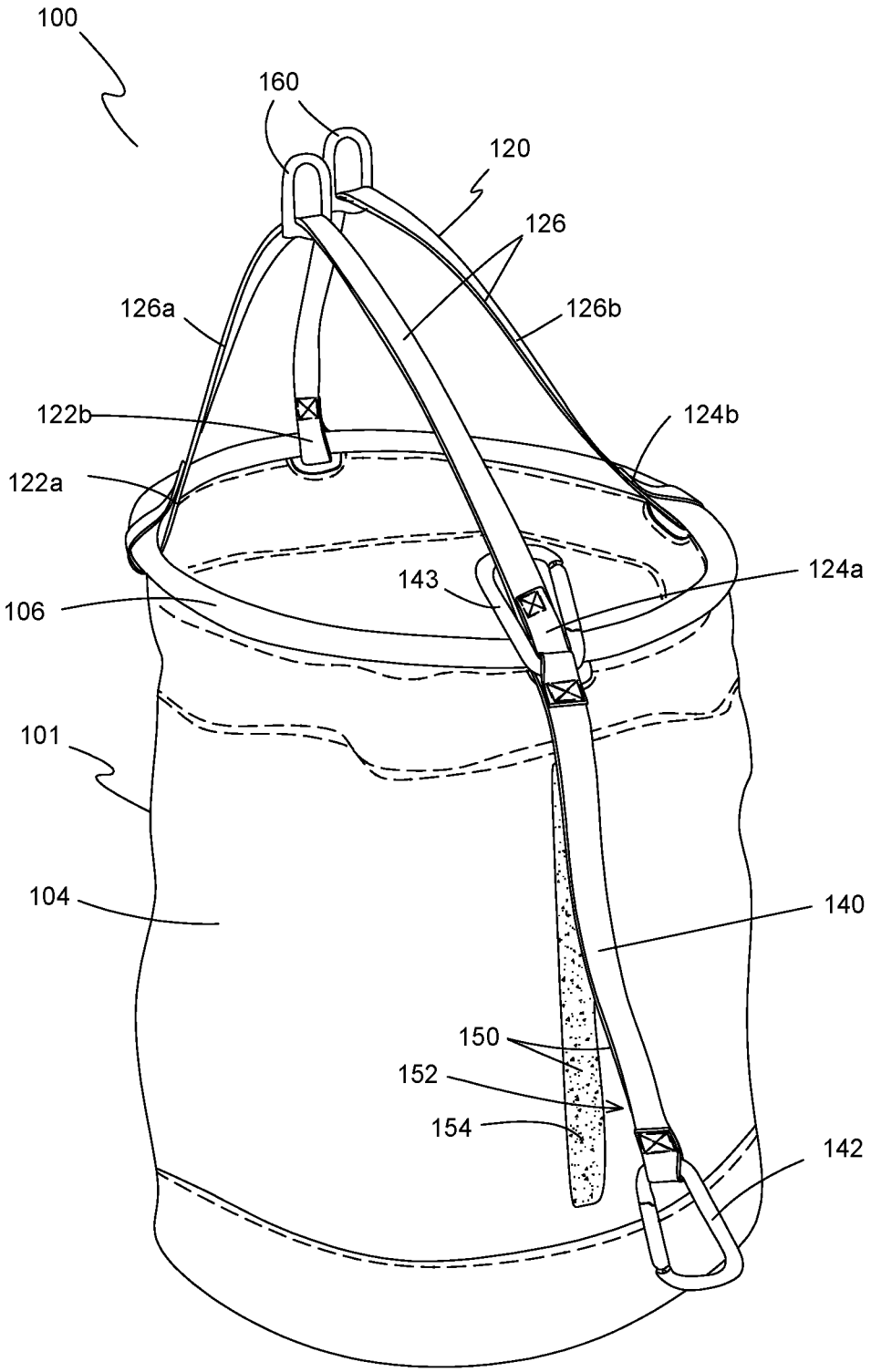
FIG. 7 is a perspective illustration of a tool bag of the present invention showing the carrying handle that includes first and second handle portions each with bag-suspending connectors, and also the showing auxiliary loop member slidably attached to one of the handle portions.

Referring now to FIG. 7, a perspective illustration shows another embodiment of tool bag 100. In this embodiment, carrying handle 120 includes a first handle body portion 126*a* and a second handle body portion 126*b* of about equal length. Each of first and second handle body portions 126*a*, 126*b* includes bag-suspending connector 160, such as a D-ring as illustrated. As noted above, each bag-suspending connector 160 may be fixed or movable along handle body portion 126. First and second handle body portions 126*a*, 126*b* each have first end portion 122*a*, 122*b* and second end portion 124*a*, 124*b*, respectively. First end portion 122*a* and second end portion 124*a* of first handle body portion 126*a* are spaced from each other along mouth 106 as well as being spaced from first end portion 122*b* and second end portion 124*b* of second handle body portion 126*b*, which are also spaced from each other. In one embodiment, first and second handle portions 122*a*, 122*b*, 124*a*, 124*b* are evenly distributed along mouth 106.

Auxiliary loop member 140 is connected to one of first or second handle body portions 126*a*, 126*b*. As shown, auxiliary loop member 140 is slidably connected to first handle body portion 126*a* by connector loop 143, which is a carabiner. Releasable fastener 150 is optionally disposed between container 101 and auxiliary loop member 140, where first fastener part 152 (not visible) is on auxiliary loop member 140 and second fastener part 154 is on sidewall 104 of container 101. As discussed above, other embodiments of tool bag 100 include sidewall connector 170 (shown in FIG. 5) in addition to or in place of releasable fastener 150. Auxiliary loop member 140 may be looped over structure 200 (shown in FIG. 2). After bringing together first and second handle body portions 126*a*, 126*b*, closed loop 142 is then connected to both bag-suspending connectors 160.

In use, embodiments of tool bag 100 can be attached to structures 200 that are too large to be captured by bag-suspending connector 160. By looping auxiliary loop member 140 over structure 200 and capturing closed loop 142 of auxiliary loop member 140 in bag-suspending connector 160, auxiliary loop member 140 is useful to suspend tool bag 100 without the need for a separate strap. When equipped with releasable fastener 150, the user connects first fastener part 152 to second fastener part 154 to retain auxiliary loop member 140 releasably attached to carrying handle 120 (and sidewall 104 in some cases) to maintain auxiliary loop member 140 in a convenient, stowed position when not in use. When needed, the user separates releasable fastener 150 to release auxiliary loop member 140.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

We claim:

1. A tool bag comprising:

a container having a bottom and a sidewall extending up from the bottom to an open mouth;

a carrying handle made of a pliable material and having a handle body portion, a first end portion, and a second end portion, wherein the first end portion is attached to the container adjacent the open mouth and the second end portion is attached to the container adjacent the open mouth and spaced from the first end portion, wherein the handle body portion is capable of extending over the open mouth of the container;

an auxiliary loop member having a first auxiliary end portion secured directly to the handle body portion and an auxiliary member body portion extending separately from and capable of being aligned with the carrying handle to a second auxiliary end portion, the second auxiliary end portion defining a closed loop; and a bag-suspending connector connected to the carrying handle.

2. The tool bag of claim 1 further comprising a releasable fastener with a first fastener part on the auxiliary member body portion and a second fastener part on the handle body portion, thereby rendering the auxiliary loop member releasably attachable to the carrying handle.

3. The tool bag of claim 2, wherein the first auxiliary end portion of the auxiliary loop member is secured at about a midpoint of the carrying handle and the auxiliary member body portion has a length sufficient to extend along the sidewall when the auxiliary loop member is releasably attached to the handle body portion.

4. The tool bag of claim 3, further comprising a second connector part on the sidewall, thereby also rendering the auxiliary loop member releasably attachable to the sidewall.

5. The tool bag of claim 1, wherein the handle body portion comprises a first handle body portion and a second handle body portion and wherein the bag-suspending connector includes a first bag-suspending connector connected to the first handle body portion and a second bag-suspending connector connected to the second handle body portion.

6. The tool bag of claim 1, wherein the first auxiliary end portion is secured to the carrying handle at about a midpoint of the handle body portion.

7. The tool bag of claim 1, wherein the bag-suspending connector is slidable along the carrying handle.

8. The tool bag of claim 1, wherein the bag-suspending connector is fixed at about a midpoint of the carrying handle.

9. The tool bag of claim 1, wherein at least one of the first end portion and the second end portion includes an additional connector releasably connected through an opening in the sidewall adjacent the mouth of the container.

10. The tool bag of claim 9, wherein the carrying strap is removable from the container.

11. The tool bag of claim 1, wherein the closed loop on the second auxiliary end portion is a connector operable between an open position and a closed position.

12. The tool bag of claim 1, wherein the first auxiliary end portion of the auxiliary loop member defines a connector loop that is slidable along the carrying handle.

13. The tool bag of claim 12, wherein the container further comprises a container connector attached to a lower end portion of the container, wherein the container connector is constructed to capture the closed loop on the second auxiliary end portion of the auxiliary loop member.

14. A tool bag comprising:

a container having a bottom and a sidewall extending up from the bottom to an open mouth;

a carrying handle made of a pliable material and having a handle body portion, a first end portion, and a second end portion, wherein the first end portion is attached to the container adjacent the open mouth and the second end portion is attached to the container adjacent the open mouth and spaced from the first end portion, wherein the handle body portion is capable of extending over the open mouth of the container;

an auxiliary loop member having a first auxiliary end portion secured to the handle body portion and an auxiliary member body portion extending separately from and capable of being aligned with the carrying handle to a second auxiliary end portion defining a closed loop that is a portion of the auxiliary member body portion that is folded over itself; and a bag-suspending connector connected to the carrying handle.

15. The tool bag of claim 14, wherein the carrying handle and the container both include one of a hook fastener and a loop fastener; wherein the hook fastener can be secured to the loop fastener.

16. The tool bag of claim 14, wherein the auxiliary strap body has a stowed configuration in which the auxiliary strap body extends along the carrying handle and down along a sidewall of the container.

17. The tool bag of claim 14, wherein the closed loop can be secured to a side of the container body.

18. A tool bag comprising:

a container having a bottom and a sidewall extending up from the bottom to an open mouth;

a carrying handle made of a pliable material and having a handle body portion, a first end portion, and a second end portion, wherein the first end portion is attached to the container adjacent the open mouth and the second end portion is attached to the container adjacent the open mouth and spaced from the first end portion, wherein the handle body portion is capable of extending over the open mouth of the container;

an auxiliary loop member having a first auxiliary end portion secured to the handle body portion and an auxiliary member body portion extending separately from and capable of being aligned with the carrying handle to a second auxiliary end portion defining a closed loop; and a bag-suspending connector connected to the carrying handle, wherein the first auxiliary end portion is secured to the carrying handle at about a midpoint of the handle body portion.

* * * * *